US007713141B2

(12) United States Patent
Yamamoto

(10) Patent No.: US 7,713,141 B2
(45) Date of Patent: May 11, 2010

(54) GOLF CLUB HEAD

(75) Inventor: Akio Yamamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 63 days.

(21) Appl. No.: 11/806,019

(22) Filed: May 29, 2007

(65) Prior Publication Data

US 2008/0032815 A1 Feb. 7, 2008

(30) Foreign Application Priority Data

Aug. 3, 2006 (JP) ..... 2006-212170

(51) Int. Cl.
*A63B 53/04* (2006.01)

(52) U.S. Cl. ..... 473/332; 473/346; 473/350

(58) Field of Classification Search ..... 473/324–350
See application file for complete search history.

(56) References Cited

U.S. PATENT DOCUMENTS 6,991,559 B2 * 1/2006 Yabu ..... 473/332
7,186,188 B2 * 3/2007 Gilbert et al. ..... 473/290
7,207,899 B2 4/2007 Imamoto
7,281,988 B2 * 10/2007 Hou ..... 473/326
7,476,162 B2 * 1/2009 Stites et al. ..... 473/332
7,575,523 B2 * 8/2009 Yokota ..... 473/332
2003/0199331 A1 * 10/2003 Stites, III ..... 473/290
2005/0239572 A1 * 10/2005 Roach et al. ..... 473/332

FOREIGN PATENT DOCUMENTS

JP 2005118526 A * 5/2005

* cited by examiner

*Primary Examiner*—Alvin A Hunter
(74) *Attorney, Agent, or Firm*—Birch, Stewart, Kolasch & Birch, LLP

(57) ABSTRACT

A golf club head having a good impact-absorbing property improved to provide a good hitting feel without deteriorating the repulsion property, which includes a metallic face member 8 including at least a part of face F, and a metallic head body 9 to be joined with face member 8, wherein the face member 8 has back surface 8*b*, and the head body 9 has receiving surface 12 contacting a periphery 8*be* of the back surface 8*b*, and fold-back portion 14 which extends backward of the head from the receiving surface 12 and is folded toward the head center without contacting the back surface 8*b* so that it has opposite surface 18 facing the back surface 8*b* and it forms space 13 between them, and wherein at least one impact-absorbing member 15 made of an elastic material is disposed in the space 18 such that a front portion 15*a* thereof is in contact with the back surface 8*b*, a rear portion 15*b* thereof is in contact with the opposite surface 18 and a middle portion thereof between them extends in the space 13 without contacting both the face member and the head body to form a non-bound portion 15*c*.

31 Claims, 11 Drawing Sheets

GOLF CLUB HEAD

BACKGROUND OF THE INVENTION

The present invention relates to a golf club head capable of providing an excellent ball hitting feeling improved by enhancing an impact-absorbing property of the club head, which is exhibited at the time of hitting a golf ball, without lowering the repulsion property.

In recent years, in order to obtain a good ball hitting feeling, there is proposed, for example in U.S. Pat. No. 7,207,899 B2, a golf club head "a" which includes, as shown in FIG. 13, a head body "b", a face plate "c" disposed on the front side of the head body, and an elastic member "d" for impact absorption disposed in a compressed state in a recess located between the head body "b" and the face plate "c". The elastic member "d" is disposed so that a back surface "d1" and peripheral surfaces "d3" and "d4" of the elastic member come into contact with the head body "b" and the front surface "d2" of the elastic member comes into contact with a back surface of the face plate "c".

In the club head "a" having such a structure, the peripheral surfaces "d3" and "d4" of the elastic member "d" are supported by the head body "b". Therefore, the head body "d" which accommodates the impact-absorbing elastic member "d" must be prepared into a relatively large size, so a free bending region Z of the face plate "c", which is not supported by the head body "b", tends to decrease. Since the bending of the face place "c" on impact becomes small, such a golf club head "a" is apt to deteriorate its repulsion property. Further, since the impact-absorbing elastic member "d" is disposed in such a state as being almost bound by the head body "b", generation of strain is restricted and, therefore, a vibration-absorbing effect might be decreased.

It is an object of the present invention to provide a golf club head having a high impact-absorbing property enhanced without lowering the repulsion property.

A further object of the present invention is to provide an iron-type golf club head having a good feeling of striking a golf ball and a good repulsion property.

These and other objects of the present invention will become apparent from the description hereinafter.

SUMMARY OF THE INVENTION

It has been found that the above objects can be achieved by providing, in a space formed between a head body and a face member which constitute a golf club head, typically a cavity back iron-type golf club head, at least one relatively small impact-absorbing member which has a non-bound portion extending between the head body and the face member without coming into contact with them.

In accordance with the present invention, there is provided a golf club head including a face member comprising a metallic material and including at least a part of a ball hitting face, and a head body comprising a metallic material to which the face member is attached, wherein the face member has a face back surface which is the back of the hitting face, and the head body has a receiving surface which is in contact with a periphery of the face back surface of the face member, and a fold-back portion which extends backward of the head from the receiving surface and is folded toward the center of the head without coming into contact with the face back surface so that it has an opposite surface facing the face back surface and it forms a space between the face back surface and the opposite surface, and wherein at least one impact-absorbing member made of an elastic material is disposed in the space such that a front portion thereof is in contact with the face back surface, a rear portion thereof is in contact with the opposite surface and a middle portion thereof between the front portion and the rear portion extends in the space without coming into contact with both the face member and the head body to form a non-bound portion.

Preferably, the rear portion of the impact-absorbing member is inserted into a recess formed in the opposite surface of the head body. In a preferable embodiment, the impact-absorbing member is in the form of a column having a center line perpendicular to the face back surface, and comprises at least a toe side impact-absorbing body disposed on the toe side of the head and a heel side impact-absorbing body disposed on the heel side of the head. Preferably, the volume of the toe side impact-absorbing body or the total volume of the toe side impact-absorbing bodies disposed on the toe side of the head is larger than the volume of the heel side impact-absorbing body or the total volume of the heel side impact-absorbing bodies disposed on the heel side of the head. In a preferable embodiment, an annular groove or recess portion surrounding a sweet spot region is formed in the face back surface of the face member at a location of a free bending region surrounded by the receiving surface of the head body, and the front portion of the impact-absorbing member is in contact with the face back surface within the annular groove or recess portion.

The golf club head of the present invention is provided with an impact-absorbing member made of an elastic material in a space formed between the back surface of a face member and the facing surface of a fold-back portion of a head body attached to the face member. The impact-absorbing member is disposed such that a front portion thereof is in contact with the back surface and a rear portion thereof is in contact with the opposite surface, while leaving a middle portion between them as a non-contacting, non-bound portion. Therefore, vibration of the face member and/or the head body at impact is transmitted to the impact-absorbing member, converted into heat, and absorbed. Since the impact-absorbing member has, between the front and rear portions thereof, a non-bound portion extending in a space without contacting both the face member and the head body and since the non-bound portion can vibrates freely without any restriction, the impact-absorbing member can exhibit a large vibration-damping effect. Further, since the fold-back portion of the head body extends toward the center of the head without contacting the back surface of the face member, it does not impair bending of the face member on impact and, therefore, the repulsion property of the head is not deteriorated.

DETAILED DESCRIPTION OF THE INVENTION

An embodiment of the present invention will now be explained with reference to the accompanying drawings.

Figure 1:
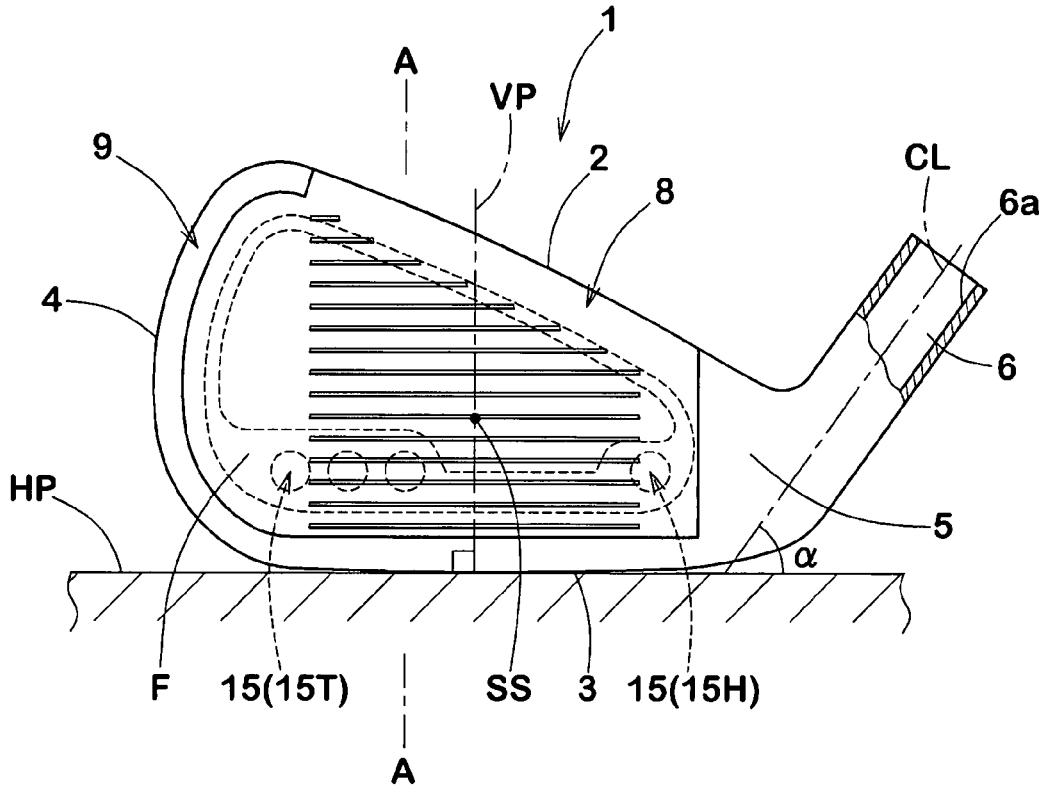
FIG. 1 is a front view of an iron-type golf club head in the standard state according to an embodiment of the present invention.
Figure 2:
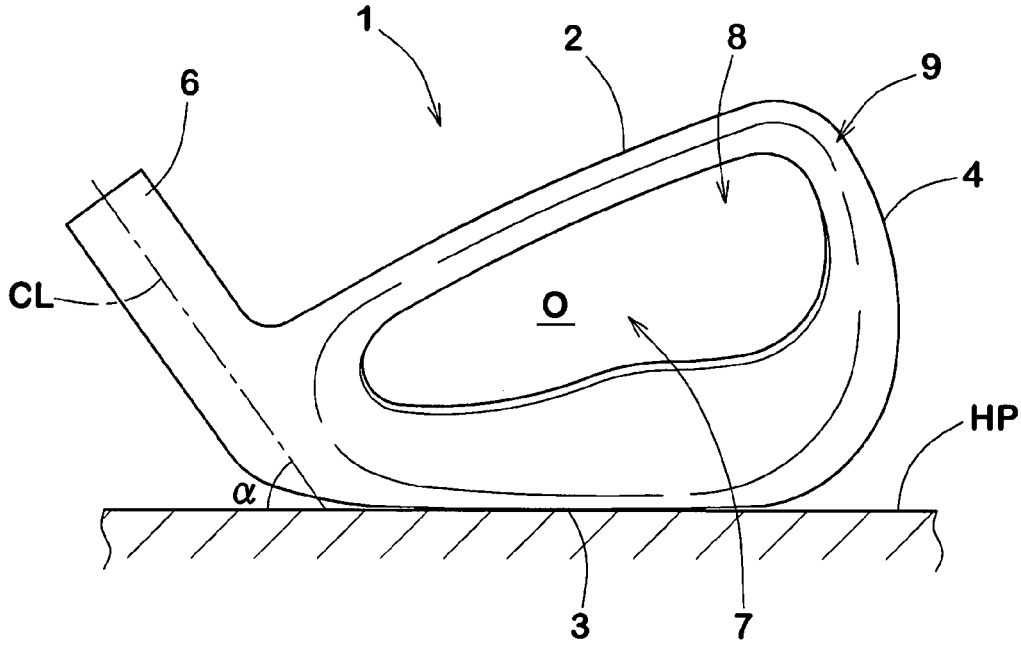
FIG. 2 is a back view of the club head of FIG. 1.
Figure 3:
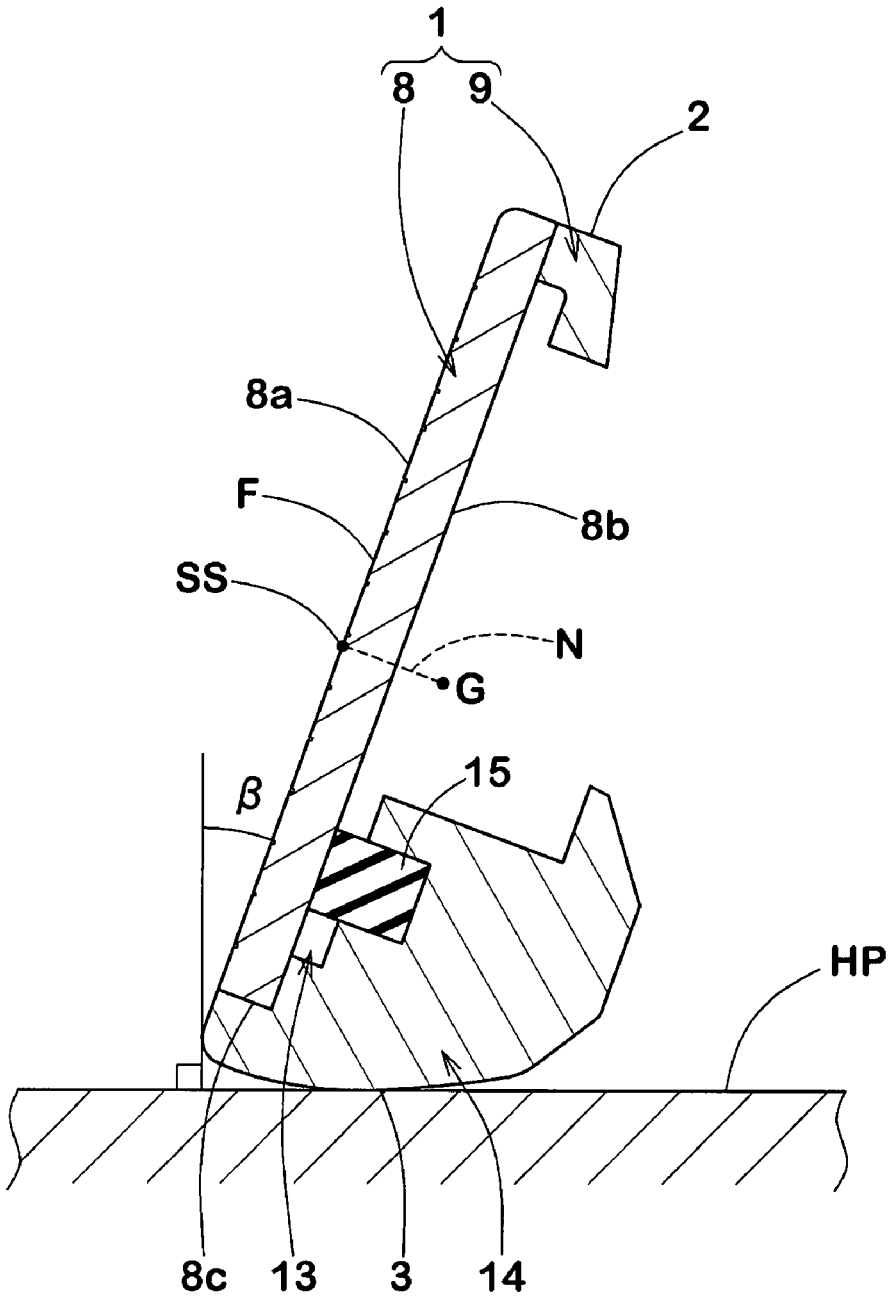
FIG. 3 is an enlarged cross sectional view along the line A-A of FIG. 1.
Figure 4:
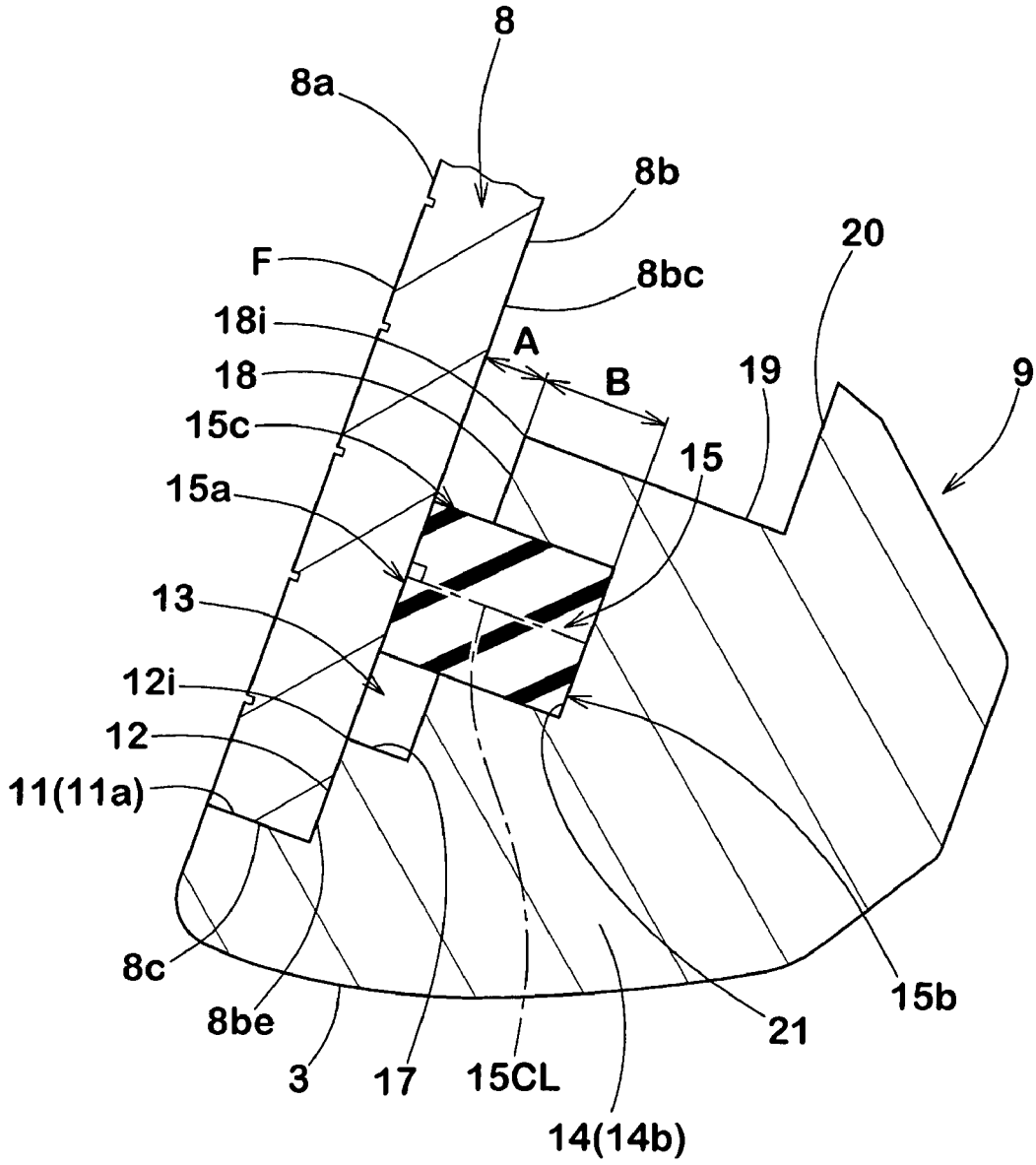
FIG. 4 is a partial enlarged view of FIG. 3.

FIGS. 1 to 4 show an iron-type golf club head 1 according to an embodiment of the present invention, in which FIG. 1 is a front view of the head 1, FIG. 2 is a back view thereof, FIG. 3 is a cross section view along the line A-A of FIG. 1, and FIG. 4 is an enlarged view of a sole side portion shown in FIG. 3. In these drawings, the club head 1 is placed in the standard state. The term "standard state" as used herein denotes the state that the club head 1 is placed on a horizontal plane HP with keeping prescribed lie angle $\alpha$ and loft angle (real loft angle) $\beta$.

The iron-type golf club head 1 in this embodiment includes a face F for hitting a golf ball, a top 2 which intersects with the face F at its upper edge and forms the upper surface of the head 1, a sole 3 which intersects with the face F at its lower edge and forms the bottom surface of the head 1, a toe 4 connecting the top 2 and the sole 3 on the toe side, a neck 5 disposed on the heel side of the face F, a hosel 6 continuous with the neck 5 and having a hole 6*a* for inserting a shaft (now shown), and a back face 7 which forms a back surface of the head. The lie angle $\alpha$ of the head 1 is determined based on the axial center line CL of the shaft inserting hole 6*a*.

The club head 1 comprises a face member 8 made of a metallic material including at least a part of the face F, and a head body 9 made of a metallic material to which the face member is joined.

The metallic material of the face member 8 is not particularly limited, but a metallic material having a high strength and a high repulsion property is preferred, e.g., titanium, titanium alloy, aluminum alloy or SUS 450 (maraging steel). A titanium alloy is preferably used for the face member 8 in this embodiment.

Figure 5:
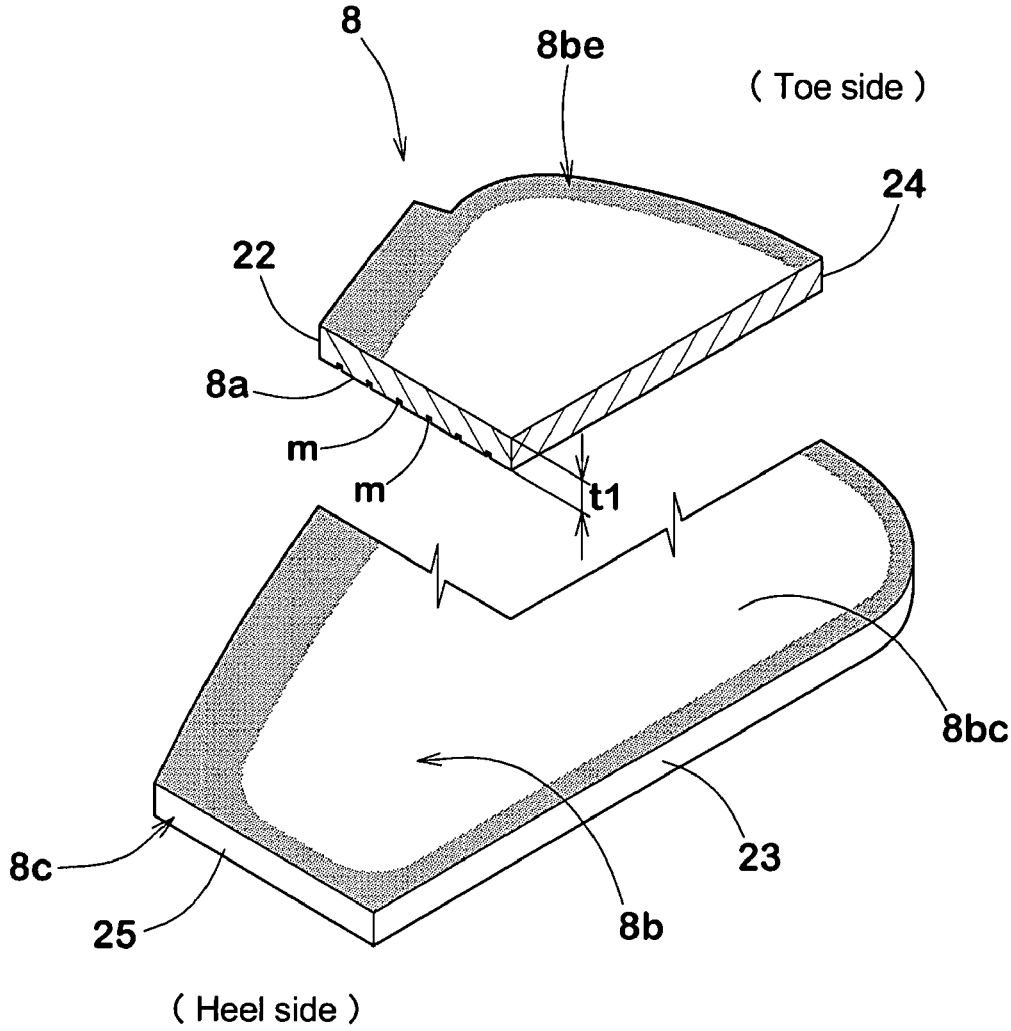
FIG. 5 is a perspective view of a face member viewed from its back surface side.

FIG. 5 shows a perspective view of the face member 8 in this embodiment viewed from its back surface side. The face member 8 is constituted by a plate or plate-like body which includes a front surface 8*a* constituting a main portion of the face F, a face back surface 8*b* which is a face on the side opposite to the front surface 8*a*, and a side surface 8*c* which connects the front and back surfaces 8*a* and 8*b* and annularly extends.

The front surface 8*a* is formed into substantially a single plane, excepting an impact area marking "m" such as groove.

The side surface 8*c* includes an upper side surface 22 which is located on the top 2 side and exposed to the outside as at least a part of the top face 2, a lower side surface 23 which is located on the sole 3 side and extends along the sole 3, a toe side surface 24 which connects the upper side surface 22 and the lower side surface 23 on the toe 4 side and extends along the toe 4, and a heel side surface 25 which connects the upper side surface 22 and the lower side surface 23 on the heel side and substantially vertically extends between them. The face member 8 is formed into such a shape that in the standard state viewed from the front (FIG. 1), the height of the face member 8 gradually increases from the heel side toward the toe side. In the head 1 illustrated in this embodiment, the upper side surface 22 is connected to the toe side surface 24 through a step.

The thickness t1 of the face member 8 is not particularly limited. However, if the thickness t1 is too small, the durability of the face member 8 tends to lower due to lack of strength, and if the thickness t1 is too large, the rigidity of the face member 8 excessively increases to tend to lower the repulsion property. From such points of view, the thickness t1 of the face member 8 is preferably at least 2.0 mm, more preferably at least 2.2 mm, and is preferably at most 3.5 mm, more preferably at most 3.3 mm. The face member 8 illustrated in this embodiment has substantially a constant thickness. However, the thickness of the face member 8 can be suitably changed according to a usual practice. For example, for the purpose of enhancing the repellency of the head with keeping the strength, the face member 8 may be formed so that respective portions have a different thickness, for example, a central portion is thick and a peripheral portion is thin, or vice versa.

Figure 6:
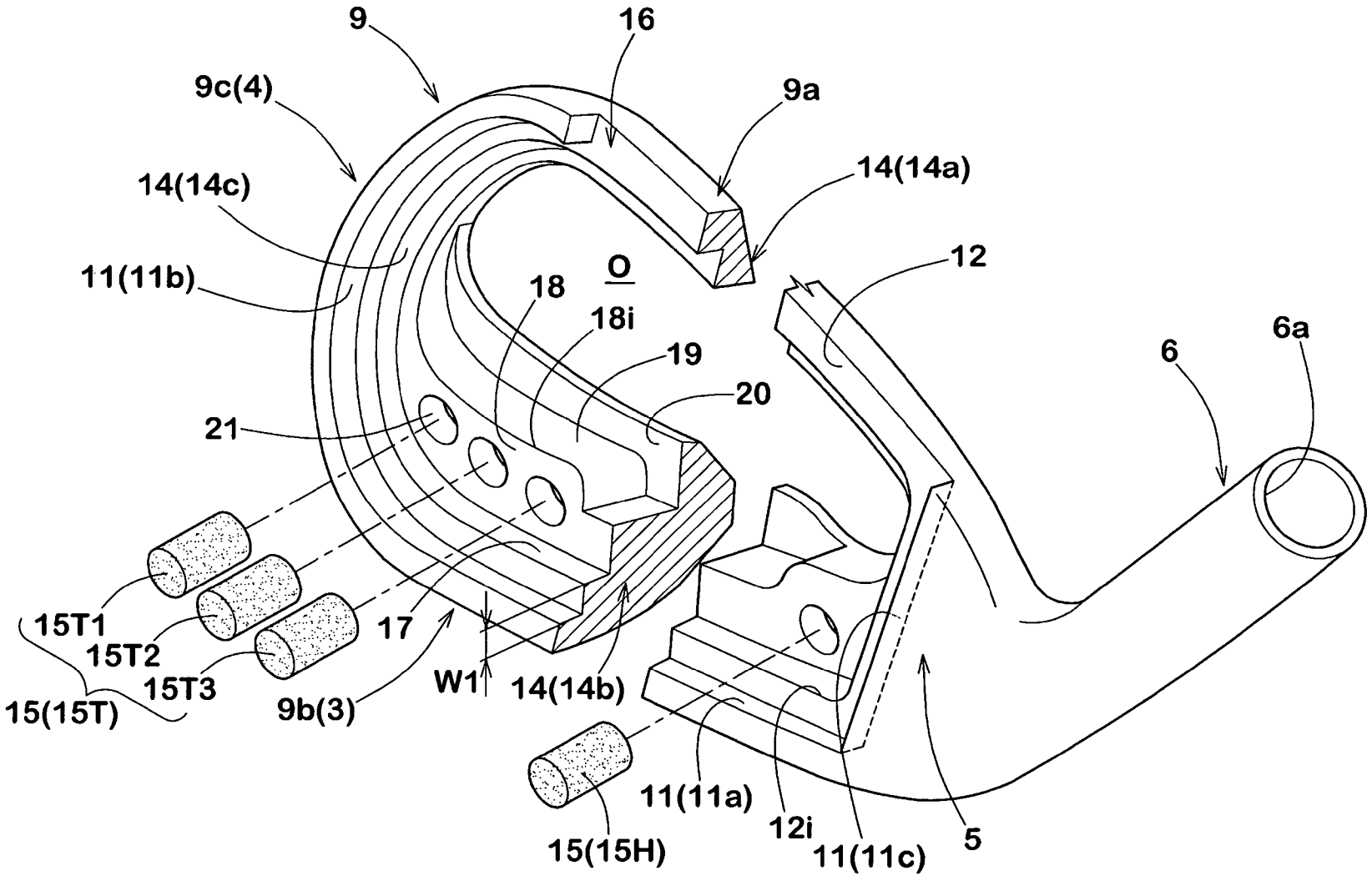
FIG. 6 is a perspective view of a head body.

In this embodiment as shown in FIG. 6, the head body 9 is provided with an opening O which passes through back and forth. The head body 9 includes a top frame 9*a* which extends along the top face 2 and which, in this embodiment, form a rear portion of the top 2 of the head, a sole frame 9*b* which extends along the sole 3 and forms substantially a whole region of the sole 3, a toe frame 9*c* which connects the top and sole frames 9*a* and 9*b* and forms substantially a whole region of the toe 4, the neck 5 and the hosel 6.

The head body 9 can be prepared from various metallic materials. Examples of the metallic material are, for instance, a stainless steel such as SUS 630, SUS 255 or SUS 450, and other metals, preferably metals having a larger specific gravity than the face member 8. By such a constitution as mentioned above, a larger amount of weight is allocated to the club's periphery, whereby a club head 1 having a large moment of inertia and a large sweet spot area can be provided. The head body 9 in this embodiment is prepared by casting to integrally form the respective portions into a body, whereby the productivity can be improved.

Figure 7:
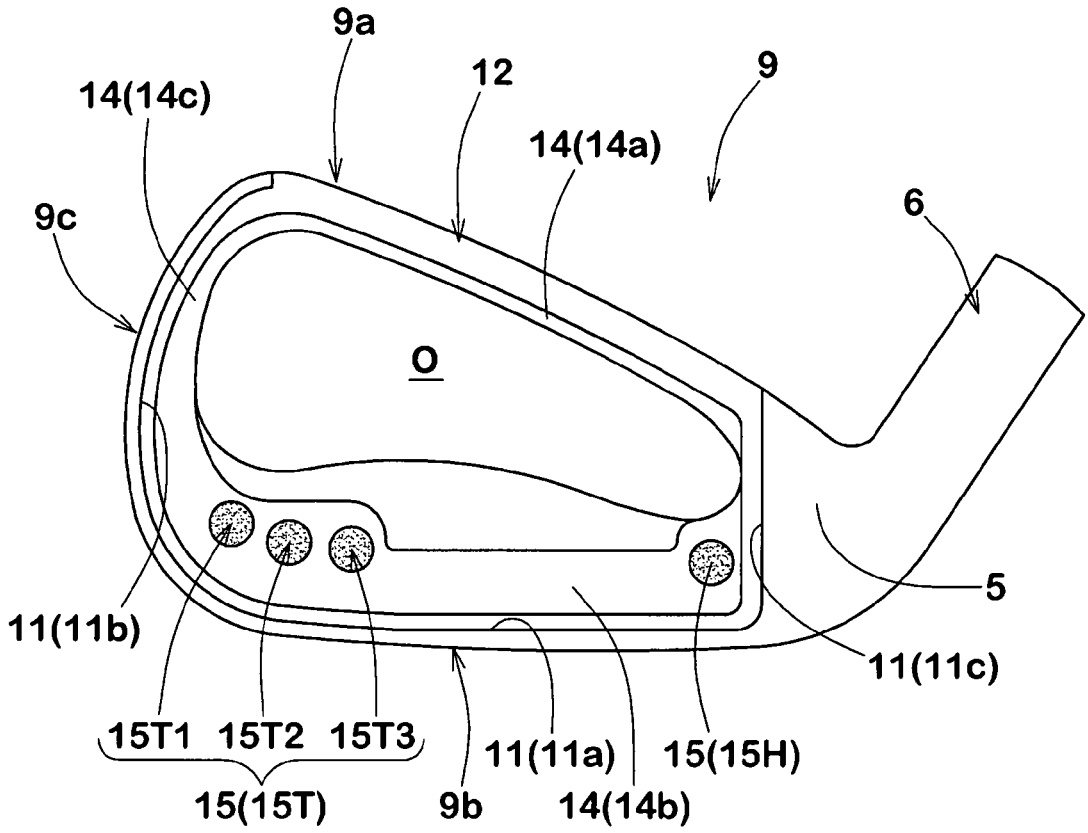
FIG. 7 is a front view of the head body.

As shown in FIGS. 4 and 6 and FIG. 7 which is a front view of the head body 9 of the head 1 shown in FIG. 1 from which the face member is detached, the head body 9 has an inside-facing surface 11 which contacts the side surface 8*c* of the face member 8 to support the face member 8, a receiving surface 12 which contacts a periphery 8*be* of the face back surface 8*b* of the face member 8, and a fold-back portion 14 which extends backward of the head from the receiving surface 12 and is folded toward the center of the head without coming into contact with the face back surface 8*b* so as to form an opposite surface 18 facing the face back surface 8*b* with keeping a space between the face back surface 8*b* and the opposite surface 18. In order to facilitate the understanding, a region in the face member 8 supported by the receiving surface 12 of the head body 9, i.e., periphery 8*be* of the face back surface 8*b*, is shown by a dotted region in FIG. 5.

The inside-facing surface 11 includes a sole inside-facing surface 11*a* which is disposed on the sole frame 9*b* and supports the lower side surface 23 of the face member 8, a toe inside-facing surface 11*b* which is disposed on the toe frame 9*c* and supports the toe side surface 24 of the face member 8, and a heel inside-facing surface 11*c* which is disposed in the neck 5 and supports the heel side surface 25 of the face member 8. These inside-facing surfaces have a width substantially the same as the thickness t1 of the face member 8.

On the other hand, the top frame 9*a* is not provided with such an inside-facing surface, and is partly cut off to form a broken portion 16, whereby at least a part of the upper side surface 22 of the face member 8 is exposed onto the top 2 through the broken portion 16 (in other words, it is exposed to the outer surface of the head). Since a part of the upper portion of the head is formed by the face member 8 which has a smaller specific gravity, such a structure is preferably in moving the center of gravity G to a lower position.

The receiving surface 12 in this embodiment is formed into a continuous annular form on top frame 9*a*, sole frame 9*b*, toe frame 9*c* and neck 5, whereby the periphery 8*be* of the face back surface 8*b* of the face member 8 is annually and contiguously supported. The receiving surface 12 is formed into a plane surface substantially parallel to the face back surface 8*b* at a location recessed backward from the face F by a distance substantially corresponding to the thickness t1 of the face member 8 so that a single surface is formed when the face member 8 is attached to the head body 9.

The inside-facing surface 11 and the receiving surface 12 are useful for surely joining the face member 8 to the head body 9, since a corner portion formed by the side surface 8*c* and face back surface 8*b* of the face member 8 can be held thereby. Also, when a broken portion 16 is formed in the top frame 9*a*, it is possible to further lower the head's center of gravity with keeping the above effect.

The present invention is not limited to the embodiment as mentioned above and, for example, the inside-facing surface 11 may be formed contiguously and annularly without forming a cut off portion in the frame of the head body 9, or the face member 8 may be supported only by the receiving surface 12 without forming the inside-facing surface 11.

The width W1 of the receiving surface 12 is not particularly limited. However, if the width W1 is too small, a sufficient area for bonding the face member 8 is not obtained, and if the width W1 is too large, the repulsion property of the face member may be decreased.

From such points of view, the width W1 of the receiving surface 12 is preferably at least 0.5 mm, more preferably at least 1.0 mm, and is preferably at most 5.0 mm, more preferably at most 3.0 mm, further preferably at most 2.0 mm.

The head body 9 is provided with a single opening O which is surrounded by top frame 9*a*, toe frame 9*c*, sole frame 9*b* and neck 5 and which passes through back and forth. Around the opening O, the above-mentioned fold-back portion 14 is formed.

The fold-back portion 14 in this embodiment includes, as shown in FIG. 7, a top side fold-back portion 14*a* disposed in the top frame 9*a*, a toe side fold-back portion 14*c* disposed in the toe frame 9*c*, and a sole side fold-back portion 14*b* disposed in the sole frame 9*b*, and they are contiguously formed.

The respective fold-back portions are formed, for example, into an approximately inverse L-shape in section, as shown in FIGS. 4 and 6. In this embodiment, it includes an inner circumferential surface 17 which extends backward of the head from an inner edge 12*i* of the receiving surface 12 (in the direction departing from the face back surface 8*b*), and an opposite surface 18 which stands up from the inner circumferential surface 17 on the head's center side and faces the face back surface 8*b* in approximately parallel therewith, thus it is disposed without contacting the face back surface 8*b*. Since the head body 9 has such a structure, the face back surface 8*b* of the face member 8 comes into contact with the head body 9 only at a location of the receiving surface 12 of the head body 9 so as to provide, on the face member 8, a free bending region 8*bc* which is surrounded by the periphery 8*be* and which does not contact the head body 9. The term "head's center side" as mentioned above means, as shown in FIG. 3, a direction to a perpendicular line N (or its extension) connecting a head's center of gravity G and a sweet spot SS.

The sole side fold-back portion 14*b* may further include a second inner circumferential surface 19 which extends from an inner edge 18*i* of the opposite surface 18 toward the back of the head, and a second opposite surface 20 which stands up from a back edge of the second inner circumferential surface 19 on the head's center side, as illustrated in this embodiment. Such a structure is preferable from the viewpoint of moving the center of gravity toward the back of the club head.

Since the sole side fold-back portion 14*b* has the first and second inner circumferential surfaces 17 and 19 and the first and second opposite surfaces 18 and 20, a step-like space 13 is formed between the face back surface 8*b* and the fold-back portion 14 on the sole side. The space 13 provides, behind the face member 8, a space that the face member 8 can freely bend backward of the head and, therefore, it serves to enhance the repulsion property of the head 1.

At least one impact-absorbing member 15 made of an elastic material is disposed in the space 13 between the face back surface 8*b* and the opposite surface 18 which is in approximately parallel with the face back surface 8*b*. The impact-absorbing member 15 includes a front portion 15*a* which is in contact with the face back surface 8*b*, a rear portion 15*b* which is in contact with the opposite surface 18 of the fold-back portion 14, and a middle portion or non-bound portion 15*c* which is between the front portion 15*a* and the rear portion 15*b* and extends in the space 13 without coming into contact with both the face member 8 and the head body 9 to form a non-bound portion. The rear portion 15*b* may be embedded in the fold-back portion 14 in order to support the impact-absorbing member 15.

The impact-absorbing member 15 which is in contact with both the face member 8 and the head body 9 absorbs a vibration of the face member 8 and the head body 9 which generates when striking a golf ball by converting it into heat, thus easing an impact conveyed to hands of a player to improve the ball striking feel. Further, since the non-bound portion 15*c* of the impact-absorbing member 15 supported at its both end portions can vibrates freely without being restricted by, for example, the head body 9, the impact-absorbing member can more largely vibrate on impact as compared with conventional golf club heads and effectively exhibit a large vibration-damping effect. Furthermore, since the fold-back portion 14 of the head body 9 is folded back and extends toward the center of the head without contacting the back surface 8*b* of the face member 8, it does not impair bending of the face member 8 on impact and, therefore, such a structure can prevent deterioration of the repulsion property of the head 1.

The length A of the non-bound portion 15*c* (the length A being identical with the thickness of the space 13 between the face back surface 8*b* and the opposite surface 18) is not particularly limited. However, if the length A is too small, the non-bound portion 15*c* does not sufficiently vibrate and the back surface 8*b* of the face member 8 deformed on impact might contact the opposite surface 18. Therefore, the length A of the non-bound portion 15*c* is preferably at least 0.3 mm, more preferably at least 0.5 mm, further preferably at least 0.7 mm. On the other hand, if the length A is too large, the size of the impact-absorbing member 15 becomes large, so the durability of the head tends to lower or there is a case where the fold-back portion 14 becomes small and it becomes difficult to allocate a sufficient weight to a periphery of the face member 8. Therefore, the length A of the non-bound portion 15*c* is preferably at most 4.0 mm, more preferably at most 3.5 mm, further preferably at most 3.0 mm.

The material of the impact-absorbing member 15 is not particularly limited so long as it is an elastic material capable of absorbing an impact. Examples of the elastic material for the impact-absorbing member 15 are, for instance, a cured rubber wherein a rubber such as NBR or IR is vulcanized by a vulcanizing agent, a thermoplastic elastomer comprising a soft segment and a hard segment such as a styrene-based thermoplastic elastomer or a urethane-based thermoplastic elastomer, a thermoplastic elastomer such as nylon, a polymer alloy wherein at least two kinds of polymers are blended or chemically bonded. Polymer alloys are preferred.

The polymer alloy is a multi-component polymer wherein a polymer is dispersed in another polymer to macroscopically form a homogeneous phase. There is a case where a polymer phase is dispersed in another polymer phase to form a heterogeneous structure though the blend is microscopically uniform. Such polymer alloys are well known in the art and widely used for modification of resins and rubbers since new properties are provided in addition to simple additive or average properties of the polymers to be blended. Preferable examples of the polymer alloys are styrene-based thermoplastic elastomers commercially available from Mitsubishi Chemical Corporation under the trade mark "RABALON", e.g., RABALON SJ4400N, RABALON SJ5400N, RABALON SJ6400N, RABALON SJ7400N, RABALON SJ8400N, RABALON SJ9400N and RABALON SR04.

The hardness of the impact-absorbing member 15 is not particularly limited. However, if the hardness is too large, the member 15 does not exhibit a sufficient impact-absorbing ability, and if the hardness is too small, the durability tends to deteriorate. From such points of view, it is preferable that the impact-absorbing member 15 has a JIS A hardness of at least 40, especially at least 50, and has a JIS A hardness of at most 90, especially at most 80.

The shape of the impact-absorbing member 15 is not particularly limited. Preferable is a post-like shape having a center line 15CL perpendicular to the face back surface 8*b*, as illustrated in this embodiment, e.g., column or prism such as triangular prism. A columnar shape is particularly preferable. Since a columnar impact-absorbing member 15 has a circular section, it does not have any anisotropy to various vibrations in its radial direction of the non-bound portion 15*c* and therefore it can absorb vibrations which vibrate in multi-directions, in good balance.

The impact-absorbing member 15 can be disposed in the space 13 by various means. For example, the front and rear portions 15*a* and 15*b* may be adhered with an adhesive to the face back surface 8*b* and the opposite surface 18, respectively, or the rear portion 15*b* of the absorbing member 15 may be inserted into a recess or hole 21 formed in the opposite surface 18 of the head body 9, as illustrated in this embodiment. In the latter case, since the absorbing member 15 is inserted into the hole 21, the positioning and fitting of the member 15 to the head body 9 are ensured, thus enhancing the productivity and durability. Further, since the contact area between the member 15 and the head body 9 is increased thereby, the member 15 will effectively absorb a low frequency vibration generated in the head body 9.

The depth B of the hole 21 (or length B of the embedded portion of the impact-absorbing member 15) is not particularly limited. However, if the depth B is too small, the effect of increasing the contact area with the head body 9 and the positioning effect are not sufficiently obtained. Therefore, the depth B of the hole 21 is preferably at least 3.0 mm, more preferably at least 4.0 mm, further preferably at least 5.0 mm. On the other hand, if the depth B is too large, the volume of the fold-back portion 14 which as a high specific gravity is decreased, so there is a possibility that a large amount of weight is not distributed to a periphery of the face member 8. Therefore, the depth B is preferably at most 10.0 mm, more preferably at most 9.0 mm, further preferably at most 8.0 mm.

Iron-type club head 1 has many opportunities to hit a golf ball placed directly on the grass. Therefore, it tends to hit a ball at a sole side region of the face F. Therefore, it is preferable to dispose the impact-absorbing member or members 15 at least on the sole 3 side, especially at the sole side fold-back portion 14*b*, as illustrated in this embodiment.

Vibration on the sole side of head 1 generates over a location between the toe and the heel. Therefore, it is preferable that the impact-absorbing member 15 comprises at least a toe side impact-absorbing body 15T disposed on the toe side of the head 1 and a heel side impact-absorbing body 15H disposed on the heel side of the head 1. An impact can be absorbed in a wide range by disposing separately two or more impact-absorbing members 15 in a toe-heel direction at the sole side fold-back portion 14*b*, whereby the ball hitting feel is further improved. The term "toe side impact-absorbing body or member 15T" denotes an impact-absorbing member disposed on a toe side with respect to a vertical plane VP which, as shown in FIG. 1, passes through the sweet spot SS and is vertical to the face F, and the term "heel side impact-absorbing body or member 15H" denotes an impact-absorbing member disposed on a heel side with respect to the vertical plane VP.

In case of iron-type golf club head 1, if a golf ball is hit by a toe side portion of the face F with respect to the sweet spot SS, a larger moment rotating the head around the shaft axis generates as compared with hitting at a heel side portion. A part of this moment is transmitted to fingers and hands of a player through a shaft of a golf club as an uncomfortable vibration. Therefore, it is preferable to dispose the impact-absorbing members so that the volume of the toe side impact-absorbing member 15T is larger than the volume of the heel side impact-absorbing member 15H. This can be achieved, for example, by disposing a larger number of absorbing members 15T1, 15T2, 15T3 . . . on the toe side than the heel side, like this embodiment as shown in FIG. 6.

Dispersive arrangement of a plurality of the impact-absorbing members 15 in the head 1 is desirable in further enhancing the vibration-absorbing effect. Therefore, it is preferable to arrange at least two, especially at least three, more especially at least four, impact-absorbing members 15 per a head. On the other hand, if the number of the members 15 is too large, rise in cost and deterioration of productivity might occur and, therefore, it is preferable to arrange at most ten, especially at most seven, more especially at most five, impact-absorbing members 15 per a head. In case that the volume of each impact-absorbing member is substantially the same, it is preferable that the difference of the number of toe side absorbing members 15T from the number of heel side absorbing members 15H is from 1 to 3.

The volume of the impact-absorbing member 15 is not particularly limited. However, if the volume is too small, the vibration-absorbing effect tends to lower, and if the volume is too large, a large portion of the head volume is occupied by the absorbing member 15, so the head's moment of inertia tends to become small. Therefore, it is preferable that the volume of the impact-absorbing member 15 is at least 350 $mm^3$, especially at least 370 $mm^3$, more especially at least 400 $mm^3$, and with respect to the upper limit thereof, it is at most 700 $mm^3$, especially at most 680 $mm^3$, more especially at most 650 $mm^3$. In case that a plurality of impact-absorbing members 15 are disposed in the head 1, the term "volume of impact-absorbing member 15" means the total volume of all impact-absorbing members disposed.

From the viewpoint of efficiently absorbing a vibration of the face member 8 which greatly vibrates on impact, it is preferable that the contact area between the front portion 15*a* of the absorbing member 15 and the face back surface 8*b* is at least 40 $mm^2$, especially at least 50 $mm^2$, more especially at least 60 $mm^2$. On the other hand, if the contact area is too large, free bending of the face member 8 on impact might be impaired. Therefore, it is preferable that the contact area between the front portion of 15*a* of the absorbing member 15 and the face back surface 8*b* is at most 120 $mm^2$, especially at most 110 $mm^2$, more especially at most 100 $mm^2$. In case that a plurality of impact-absorbing members 15 are disposed in the head 1, the term "contact area between the impact-absorbing member and the face back surface" means the total contact area of all impact-absorbing members 15 with the face back surface 8*b*.

The club heads as illustrated in this embodiment can be produced by various methods. For example, club head 1 is produced by a method such that the face member 8 is closely adhered to the head body 9 by using a tool or a press so that a compressive force acts on the impact-absorbing member 15 in the axial direction thereof, thereby temporarily fixing them, and the resulting temporarily assembled head is then subjected to real fixing of the face member 8 and the head body 9. The impact-absorbing member 15 is, for example, such that in the free state thereof, it has a diameter smaller than that of recess or hole 21 formed in the fold-back portion 14 of the head body 9 and has a length larger than the sum of the width of the space 13 and the depth of the hole 21. Such an impact-absorbing member 15 comes into intimate contact with the inner surface of the hole 21 as a result of compressive deformation thereof in the hole 21 by a compressive force as mentioned above applied when assembling the face member 8 and the head body 9, while it comes into contact with the face back surface 8*b* at a high contact pressure, whereby a high vibration-absorbing effect can be exhibited together with improvement in productivity. The real fixing can be conducted by various known methods or means, e.g., caulking, adhesion with an adhesive agent, screwing, pressure insertion, brazing, welding, or combinations thereof.

In the embodiment illustrated above, recess or holes 21 for fitting the rear portion 15*b* of the impact-absorbing members 15 are formed in the opposite surface 18 of the head body 9. A recess or holes (not shown) for fitting the front portion 15*a* of the impact-absorbing member 15 therein may be formed in the face member 8 in place of or in addition to the holes 21 formed in the head body 9. However, since the formation of recess or holes in the face member 8 for hitting a ball might decrease the strength of the face member, formation of holes only in the head body 9 is preferable.

Figure 8:
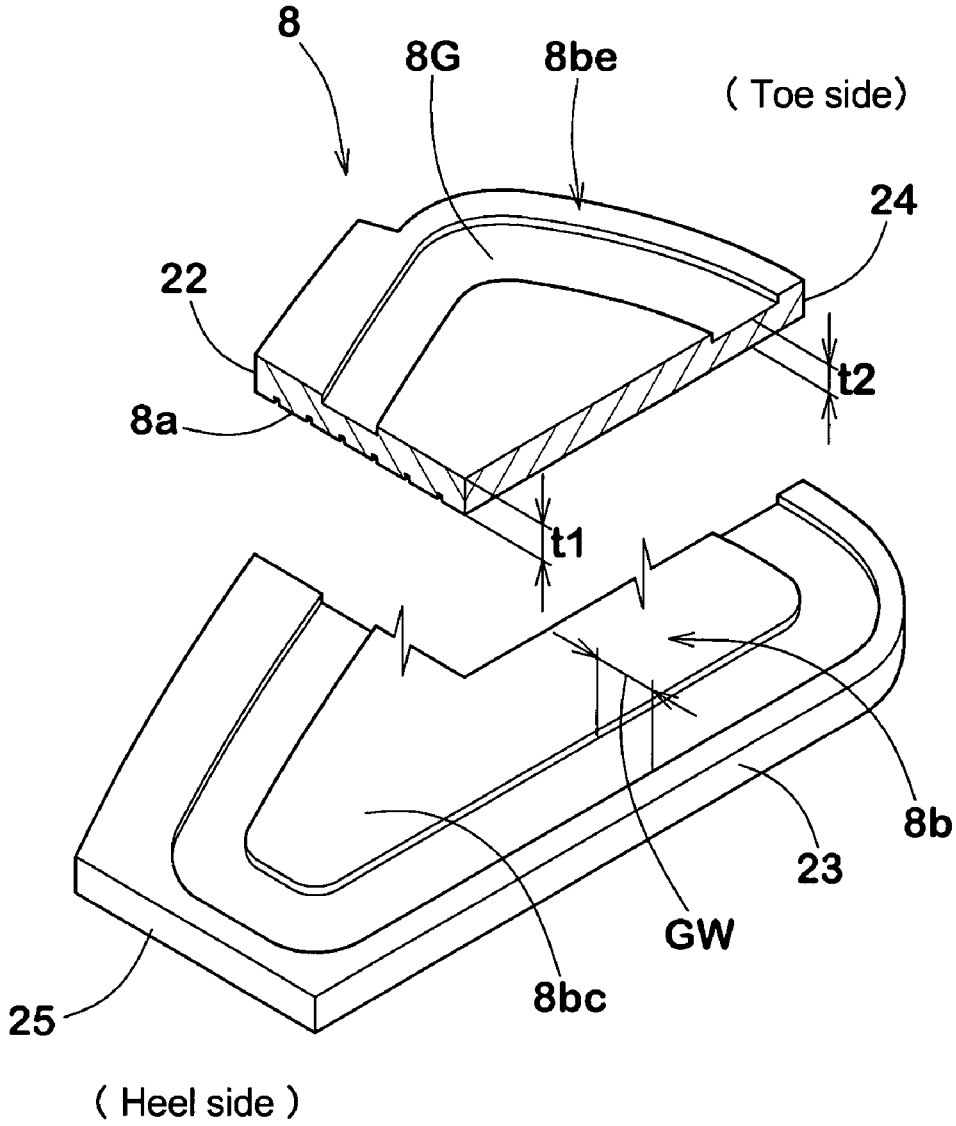
FIG. 8 is a perspective view of another face member.
Figure 9:
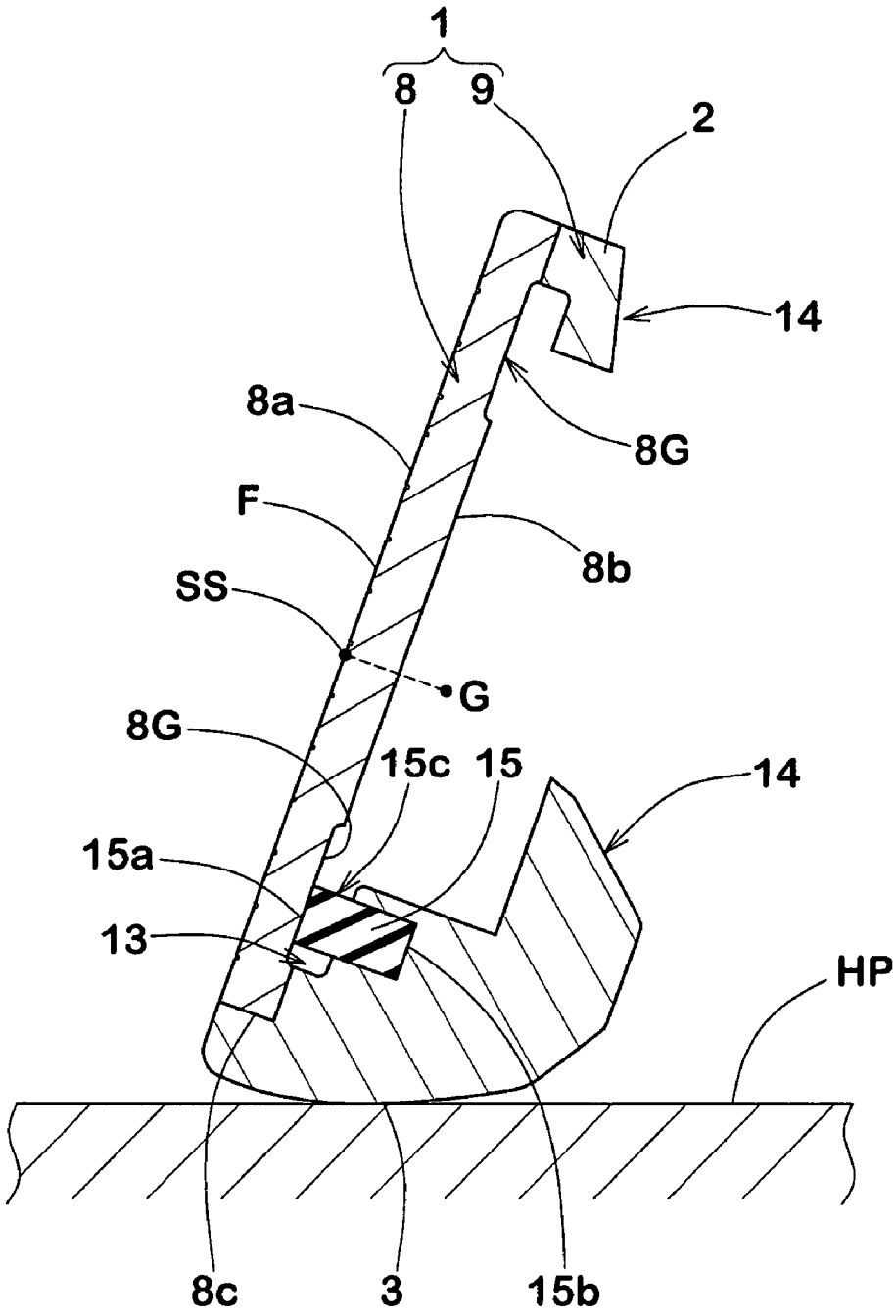
FIG. 9 is a cross sectional view of an iron-type golf club head showing another embodiment of the present invention.

FIGS. 8 and 9 show a perspective view of a face member 8 according to another embodiment of the present invention, viewed from the back side thereof, and a cross sectional view of a club head using the face member 8, respectively. The face member 8 in this embodiment has an annular groove or recess portion 8G formed to surround a sweet spot SS (shown in FIG. 9) in a free bending region 8*bc* of the face back surface 8*b*, and the front portion of the impact-absorbing member is in contact with the face back surface within the annular groove or recess portion. The front portion 15*a* of the impact-absorbing member 15 comes into contact with the face back surface 8*b* within the annular groove portion 8G.

In case of the club head 1 in such an embodiment as shown in FIGS. 8 and 9, the face member 8 bends more easily on impact, thus enhancing the repulsion property of the head 1, as compared with the embodiment shown in FIG. 5, since the rigidity of a periphery of the face member 8 is decreased. Further, since the face member 8 is easy to vibrate greatly in the vicinity of the groove portion 8G having a small rigidity, an effective vibration-absorbing action can be expected by bringing the impact-absorbing member 15 to direct contact with the groove portion 8G.

The thickness t2 of the face member 8 at a location of the annular groove portion 8G can be suitably determined. However, if the thickness t2 is too small, the durability of the face member 8 tends to deteriorate, and if the thickness t2 is too large, the effect of enhancing the repulsion property tends to decrease. From such a viewpoint, the thickness t2 is preferably at least 1.6 mm, more preferably at least 1.8 mm, and is preferably at most 2.5 mm, more preferably at most 2.3 mm. With respect to the thickness t1 of the face member 8 at a location of the free bending region 8*bc*, the thickness t1 explained with respect to a face member 8 having no annular peripheral groove in the above-mentioned first embodiment is applicable to.

From the same viewpoint as above, the width GW of the groove 8G is preferably at least 2.5 mm, more preferably at least 4.0 mm, and is preferably at most 15.0 mm, more preferably at most 10.0 mm.

Iron-type golf club heads have been described above as an embodiment of the present invention, but the present invention is of course applicable to various club heads including not only iron-type but also wood-type, putter-type and utility-type, provided that these club heads have a space 13 as mentioned above between the face member 8 and the head body 9.

The present invention is more specifically described and explained by means of the following Examples and Comparative Examples. It is to be understood that the present invention is not limited to these Examples.

EXAMPLES 1 AND 2 AND COMPARATIVE EXAMPLES 1 TO 3

Iron-type golf club heads having a loft angle of 24° according to the present invention (Examples 1 and 2) were produced based on the specifications shown in Table 1. In these Examples, a head body was produced from SUS 630 by a lost wax precision casting method, and a face member was produced from a Ti-6Al-4V alloy by press molding. Columnar elastic bodies having the same cross section and size were produced by injection molding of a polymer alloy commercially available under the trade mark "RABALON" SR04 made by Mitsubishi Chemical Corporation, and were used as an impact-absorbing member. The head body and the face member were firmly fixed to each other by caulking and with an adhesive agent, while interposing four columnar impact-absorbing members between them to give an iron-type golf club head.

Figure 10:
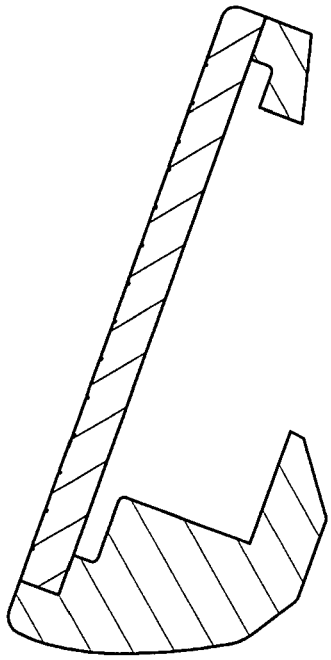
FIG. 10 is a cross sectional view of a golf club head prepared in Comparative Example 1 described after.
Figure 11:
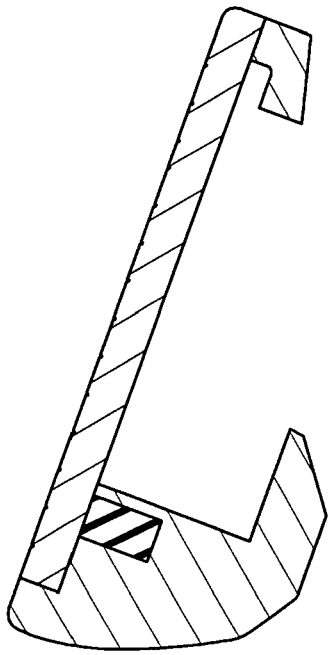
FIG. 11 is a cross sectional view of a golf club head prepared in Comparative Example 2 described after.
Figure 12:
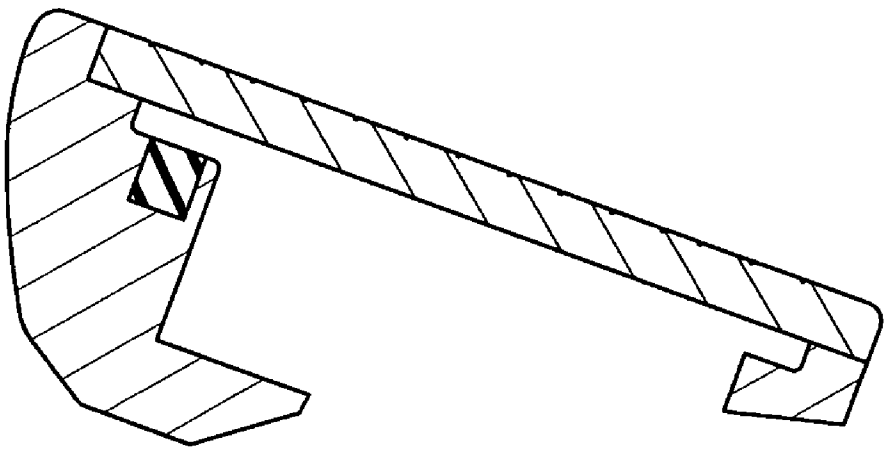
FIG. 12 is a cross sectional view of a golf club head prepared in Comparative Example 3 described after.
Figure 13:
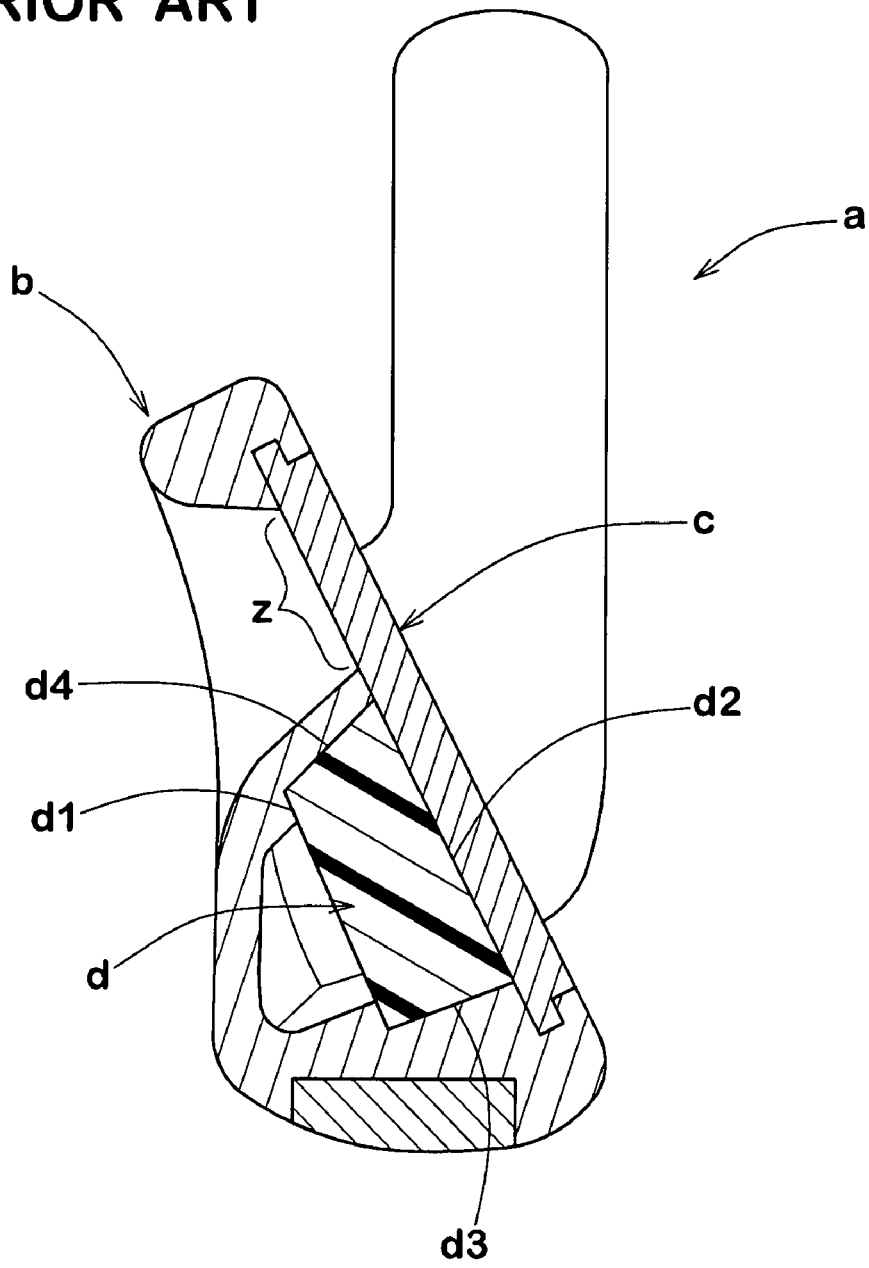
FIG.13 PRIOR ART
FIG. 13 is a cross sectional view of a conventional iron-type golf club head.

Further, in the same manner as above were produced a club head as shown in FIG. 10 having no impact-absorbing member (Comparative Example 1), a club head as shown in FIG. 11 including impact-absorbing members without a non-bound portion (Comparative Example 2) and a club head as shown in FIG. 12 including impact-absorbing members which were not in contact with the face member (Comparative Example 3).

The thus produced golf club heads were tested as follows:

(1) Hitting Feel

A shaft made of a fiber-reinforced resin (shaft "MP-200" made by SRI Sports Limited) was attached to each of the club heads to give an iron-type golf club having a club length of 38 inches. Each of ten average golfers having a handicap of 10 to 20 hit five golf balls placed on an artificial lawn with each golf club. The feel of hitting golf balls was evaluated with respect to impact force conveyed to hands when hitting a ball by a ten-rating method wherein relative evaluation regarding the best hitting feel with small impact force as a 10 rating scale was made. The results are shown by an average value of ten players. The larger the value, the better the feel of hitting ball.

(2) Repulsion Property (Pendulum Test)

The characteristic time (CT value) of each golf club head was measured according to the Pendulum Test of the United States Golf Association (USGA) provided in "Technical Description of the Pendulum Test" attached to "Notice To Manufacturers" issued from the USGA on Feb. 24, 2003. The CT value is a value (unit: μs) showing an efficiency on impact, and the larger the value, the better the repulsion property.

The results are shown in Table 1.

It is observed in Table 1 that the club heads of the Examples according to the present invention have both a good hitting feel and a good repulsion property.

TABLE 1

| | Com. Ex. 1 | Com. Ex. 2 | Com. Ex. 3 | Example 1 | Example 2 |
|---|---|---|---|---|---|
| Structure of head | FIG. 10 | FIG. 11 | FIG. 12 | FIG. 3 | FIGS. 8 and 9 |
| Face member | | | | | |
| Thickness t1 (mm) | 2.2 | 2.2 | 2.2 | 2.2 | 2.2 |
| Thickness t2 (mm) | — | — | — | — | 2.0 |
| Groove width GW (mm) | — | — | — | — | 10.0 |
| Impact-absorbing member | | | | | |
| Depth B of hole for supporting impact-absorbing member (mm) | — | 7.0 | 5.0 | 5.0 | 5.0 |
| Length A of non-bound portion (mm) | — | 0 | 0 | 2.0 | 2.2 |
| Volume of impact-absorbing member ($mm^3$) | 0 | 420 | 350 | 420 | 432 |
| Contact area of impact-absorbing member with face back surface ($mm^2$) | 0 | 60 | 0 | 60 | 60 |
| Results | | | | | |
| Hitting feel (1-10 ratings) | 4.1 | 5.1 | 6.5 | 9.0 | 9.2 |
| CT value in pendulum test (μs) | 250 | 225 | 250 | 250 | 260 |

What is claimed is:

1. A golf club head including a face member comprising a metallic material and including at least a part of a ball hitting face, and a head body comprising a metallic material to which said face member is attached, wherein said face member has a face back surface which is the back of said hitting face, and said head body has a receiving surface which is in contact with a periphery of said face back surface of said face member, and a fold-back portion which extends backward of said head from said receiving surface and is folded toward the center of said head without coming into contact with said face back surface so that it has an opposite surface facing said face back surface and it forms a space between said face back surface and said opposite surface, and wherein two to ten impact-absorbing members made of an elastic material and including at least a toe side impact-absorbing member disposed on the toe side of said head and a heel side impact-absorbing member disposed on the heel side of said head are disposed in said space, each of said impact-absorbing members includes a front portion which is in contact with said face back surface, a rear portion which is in contact with said opposite surface and a non-bound portion which is located between said front portion and said rear portion and extends in said space without coming into contact with both said face member and said head body, and said opposite surface of said fold-back portion is provided with holes for inserting said rear portion of each of said impact-absorbing members.

2. The golf club head of claim 1, wherein each of said impact-absorbing members is in the form of a column having a center line perpendicular to said face back surface.

3. The golf club head of claim 2, wherein said toe side impact-absorbing member has a volume larger than that of said heel side impact-absorbing member.

4. The golf club head of claim 1, wherein an annular recess portion surrounding a sweet spot region is formed in said face back surface of said face member at a location of a free bending region surrounded by said receiving surface of said head body, and said front portion of each of said impact-absorbing members is in contact with said face back surface within said annular recess portion.

5. The golf club head of claim 1, wherein said impact-absorbing members have a post-like shape having a center line perpendicular to said face back surface.

6. The golf club head of claim 1, wherein said impact-absorbing members have a columnar, prism or triangular prism shape having a center line perpendicular to said face back surface.

7. The golf club head of claim 1, wherein said impact-absorbing members have a JIS A hardness of 40 to 90.

8. The golf club head of claim 1, wherein the total volume of said impact-absorbing members is from 350 to 700 $mm^3$.

9. The golf club head of claim 1, wherein said non-bound portion has a length of 0.3 to 4.0 mm.

10. The golf club head of claim 1, wherein said holes have a depth of 3.0 to 10.0 mm.

11. The golf club head of claim 1, wherein said rear portion of each of said impact-absorbing members is inserted into each of holes which are provided in said opposite surface of said fold-back portion and have a depth of 3.0 to 10.0 mm, and said non-bound portion of each of said impact-absorbing members has a length of 0.3 to 4.0 mm.

12. The golf club head of claim 11, wherein said holes have a depth of 4.0 to 10.0 mm, and said non-bound portion has a length of 0.3 to 3.0 mm.

13. The golf club head of claim 1, wherein the total contact area between the front portions of said impact-absorbing members and said face back surface of said face member is from 40 to 120 $mm^2$.

14. The golf club head of claim 1, which is an iron-type golf club head and wherein the number of said impact-absorbing members disposed on the toe side is larger than those disposed on the heel side.

15. The golf club head of claim 1, wherein a side surface of said face member includes an upper side surface exposed to the outside of the head at the top thereof.

16. The golf club head of claim 1, wherein said fold-back portion includes a sole side fold-back portion located on a sole side of said head, and the opposite surface of said sole side fold-back portion includes a first opposite surface facing said face back surface to form said space and a second opposite surface standing up from a back edge of an inner circumferential surface which extends from an inner edge of said first opposite surface toward the back of the head.

17. The golf club head of claim 16, wherein said first opposite surface and said second opposite surface are parallel to said face back surface.

18. The golf club head of claim 16, wherein said first opposite surface is parallel to said face back surface and is provided with separate holes for inserting the rear portions of the impact-absorbing members.

19. The golf club head of claim 16, wherein the impact-absorbing members are disposed in said space between said first opposite surface and said face back surface so that said space provides an open space.

20. A golf club head including a face member comprising a metallic material and including at least a part of a ball hitting face, and a head body comprising a metallic material to which said face member is attached, wherein said face member has a face back surface which is the back of said hitting face, and said head body has a receiving surface which is in contact with a periphery of said face back surface of said face member, and a fold-back portion which extends backward of said head from said receiving surface and is folded toward the center of said head without coming into contact with said face back surface so that it has an opposite surface facing said face back surface and it forms a space between said face back surface and said opposite surface, and wherein two to ten impact-absorbing members made of an elastic material and including at least a toe side impact-absorbing member disposed on the toe side of said head and a heel side impact-absorbing member disposed on the heel side of said head are disposed in said space, and each of said impact-absorbing members has a JIS A hardness of 40 to 90 and includes a front portion which is in contact with said face back surface, a rear portion which is in contact with said opposite surface, and a non-bound portion which is located between said front portion and said rear portion and extends in said space without coming into contact with both said face member and said head body.

21. The golf club head of claim 20, wherein an annular recess portion surrounding a sweet spot region is formed in said face back surface of said face member at a location of a free bending region surrounded by said receiving surface of said head body, and said front portion of each of said impact-absorbing members is in contact with said face back surface within said annular recess portion.

22. The golf club head of claim 20, which is an iron-type golf club head and wherein the number of said impact-absorbing members disposed on the toe side is larger than those disposed on the heel side.

23. A golf club head including a face member comprising a metallic material and including at least a part of a ball hitting face, and a head body comprising a metallic material to which said face member is attached, wherein said face member has a face back surface which is the back of said hitting face, and said head body has a receiving surface which is in contact with a periphery of said face back surface of said face member, and a fold-back portion which extends backward of said head from said receiving surface and is folded toward the center of said head without coming into contact with said face back surface so that it has an opposite surface facing said face back surface and it forms a space between said face back surface and said opposite surface, and wherein two to ten impact-absorbing members made of an elastic material and including at least a toe side impact-absorbing member disposed on the toe side of said head and a heel side impact-absorbing member disposed on the heel side of said head are disposed in said space, the total volume of said impact-absorbing members is from 350 to 700 $mm^3$, and each of said impact-absorbing members includes a front portion which is in contact with said face back surface, a rear portion which is in contact with said opposite surface and a non-bound portion which is located between said front portion and said rear portion and extends in said space without coming into contact with both said face member and said head body.

24. The golf club head of claim 23, wherein an annular recess portion surrounding a sweet spot region is formed in said face back surface of said face member at a location of a free bending region surrounded by said receiving surface of said head body, and said front portion of each of said impact-absorbing members is in contact with said face back surface within said annular recess portion.

25. The golf club head of claim 23, which is an iron-type golf club head and wherein the number of said impact-absorbing members disposed on the toe side is larger than those disposed on the heel side.

26. A golf club head including a face member comprising a metallic material and including at least a part of a ball hitting face, and a head body comprising a metallic material to which said face member is attached, wherein said face member has a face back surface which is the back of said hitting face, and said head body has a receiving surface which is in contact with a periphery of said face back surface of said face member, and a fold-back portion which extends backward of said head from said receiving surface and is folded toward the center of said head without coming into contact with said face back surface so that it has an opposite surface facing said face back surface and it forms a space between said face back surface and said opposite surface, and wherein two to ten impact-absorbing members made of an elastic material and including at least a toe side impact-absorbing member disposed on the toe side of said head and a heel side impact-absorbing member disposed on the heel side of said head are disposed in said space, and each of said impact-absorbing members includes a front portion which is in contact with said face back surface, a rear portion which is in contact with said opposite surface and a non-bound portion having a length of 0.3 to 4.0 mm which is located between said front portion and said rear portion and extends in said space without coming into contact with both said face member and said head body.

27. The golf club head of claim 26, wherein an annular recess portion surrounding a sweet spot region is formed in said face back surface of said face member at a location of a free bending region surrounded by said receiving surface of said head body, and said front portion of each of said impact-absorbing members is in contact with said face back surface within said annular recess portion.

28. The golf club head of claim 26, which is an iron-type golf club head and wherein the number of said impact-absorbing members disposed on the toe side is larger than those disposed on the heel side.

29. A golf club head including a face member comprising a metallic material and including at least a part of a ball hitting face, and a head body comprising a metallic material to which said face member is attached, wherein said face member has a face back surface which is the back of said hitting face, and said head body has a receiving surface which is in contact with a periphery of said face back surface of said face member, and a fold-back portion which extends backward of said head from said receiving surface and is folded toward the center of said head without coming into contact with said face back surface so that it has an opposite surface facing said face back surface and it forms a space between said face back surface and said opposite surface, and wherein two to ten impact-absorbing members made of an elastic material and including at least a toe side impact-absorbing member disposed on the toe side of said head and a heel side impact-absorbing member disposed on the heel side of said head are disposed in said space, each of said impact-absorbing members includes a front portion which is in contact with said face back surface, a rear portion which is in contact with said opposite surface and a non-bound portion which is located between said front portion and said rear portion and extends in said space without coming into contact with both said face member and said head body, and the total contact area between the front portions of said impact-absorbing members and said face back surface of said face member is from 40 to 120 $mm^2$.

30. The golf club head of claim 29, wherein an annular recess portion surrounding a sweet spot region is formed in said face back surface of said face member at a location of a free bending region surrounded by said receiving surface of said head body, and said front portion of each of said impact-absorbing members is in contact with said face back surface within said annular recess portion.

31. The club head of claim 29, is an iron-type golf club head wherein the number if said impact-absorbing members disposed on the toe side is larger than those disposed on the heel side.

* * * * *